US005156389A

United States Patent [19]

Novick

[11] Patent Number: 5,156,389

[45] Date of Patent: Oct. 20, 1992

[54] FAN DELIVERY WITH FORMAT-DEPENDENT ADJUSTABLE SIGNATURE GUIDES

[75] Inventor: Michael A. Novick, New Durham, N.H.

[73] Assignee: Heidelberg Harris GmbH, Heidelberg, Fed. Rep. of Germany

[21] Appl. No.: 687,964

[22] Filed: Apr. 19, 1991

[51] Int. Cl.[5] ..... B65H 29/00

[52] U.S. Cl. ..... 271/187; 271/315; 198/473.1

[58] Field of Search ..... 271/65, 66, 70, 72, 271/184, 185, 186, 187, 83, 315; 198/473.1

[56] References Cited

U.S. PATENT DOCUMENTS 4,522,387 6/1985 Leuthold ..... 271/187
4,925,179 5/1990 Breton et al. ..... 271/315 X

FOREIGN PATENT DOCUMENTS 0307889 3/1989 European Pat. Off. ..... 271/315
0340434 11/1989 European Pat. Off. .
0121176 6/1987 Japan ..... 271/189

*Primary Examiner*—H. Grant Skaggs
*Assistant Examiner*—Carol Lynn Druzbick
*Attorney, Agent, or Firm*—Herbert L. Lerner; Laurence A. Greenberg

[57] ABSTRACT

A fan delivery for a rotary printing press, includes a drive shaft, a fan arrangement including a plurality of fan blade assemblies disposed adjacent and spaced from one another on the drive shaft, signature guides formed with arcuate recesses, respectively mounted between mutually adjacent fan blade assemblies of the fan arrangement, and a device for adjusting at least some of the signature guides with respect to the fan blade assemblies for varying formats of signatures in accordance with the size of the signatures.

10 Claims, 3 Drawing Sheets

FAN DELIVERY WITH FORMAT-DEPENDENT ADJUSTABLE SIGNATURE GUIDES

Figure 1B:
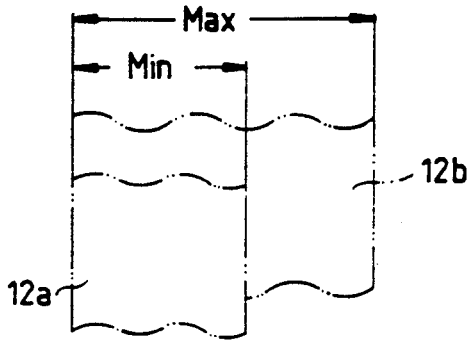

The invention relates to a fan delivery with format-dependent adjustable signature guides.

A fan delivery has become known heretofore from European Published Non-Prosecuted application (EP-US) 0 340 434 wherein one or more brake tongues, which are drawn into intermediate spaces between individual fan blade assemblies of the fan delivery, brake signatures as they enter into fan pockets formed in the fan blade assemblies. There is no disclosure in this publication of any axial displaceability of the brake tongues.

U.S. Pat. No. 4,522,387 discloses a fan wherein individual fan blade assemblies are arranged offset from one another and serve to reduce kinetic energy during the transport or conveyance of sheets. Signatures running at high speed into slots formed in the fan blade assemblies are braked by friction and deformation. Because the signatures running into the slots formed in the fan blade assemblies become deformed differently, different spacings of the lateral edges of the signatures from one another result therefrom. This provides an unsightly appearance at the delivery of the signatures and, moreover, impedes any further processing requiring precise positioning, such as, binding of the signatures. A precisely positioned delivery of the signatures would be achievable only by an additional and costly vibrator device which would be installed between the delivery tapes. This requires costly installation or assembly surfaces and should be avoided as much as possible.

It is accordingly an object of the invention to provide a fan delivery with format-dependent adjustable signature guides which avoids the foregoing disadvantages of heretofore known constructions of this general type. It is a further object of the invention to provide an improved fan delivery of the foregoing type which can process at high speeds signatures of varying formats or sizes with a highly precise delivery.

With the foregoing and other objects in view, there is provided, in accordance with the invention, a fan delivery for a rotary printing press, comprising a drive shaft, a fan arrangement including a plurality of fan blade assemblies disposed adjacent and spaced from one another on the drive shaft, signature guides formed with arcuate recesses, respectively mounted between mutually adjacent fan blade assemblies of the fan arrangement, and means for adjusting at least some of the signature guides with respect to the fan blade assemblies for varying formats of signatures in accordance with the size of the signatures.

In accordance with another feature of the invention, the adjusting means are remotely controllable.

In the foregoing constructions of the invention, the broadening of the lateral guidability of the signature for folded product which is to be delivered is of advantage. Depending upon the format of the signature to be delivered, the signature guides can be set precisely at the lateral or side edges of the signatures, and assure a high degree of accuracy in the delivery of the signatures, even at high machine operating speeds. The remote-control capability of the lateral signature guides permits a further automatization in the folder, as well as a remote control from a central control system of the printing machine.

In accordance with a further feature of the invention the fan blade assemblies are displaceable on the drive shaft in axial direction thereof.

This affords a further enlargement of the adjustment range, as well as a fine adjustment of the signature guides at the lateral or side edges of the signatures.

In accordance with an added feature of the invention, the fan blade assemblies, respectively, are formed of outwardly extending blades defining pockets therebetween, a first one of the signature guides serving as a lateral stop for a relatively small format of the signatures, and a first one of the adjustable signature guides having the arcuate recesses thereof disposed in opposite phase to the pockets between the fan blades.

In this manner, by relatively simple means, lateral guidance of small signatures which do not extend over the entire width of all of the fan blade assemblies arranged on the drive shaft is achievable. By adjusting the adjustable signature guides in circumferential direction, the fan pockets formed in the fan blade assemblies are provided laterally with a guide with which the lateral or side edge of the signatures in small format abuts.

In accordance with an added feature of the invention, the fan blade assemblies, respectively, are formed of outwardly extending blades defining pockets therebetween, a first one of the signature guides being fixed and serving as a lateral stop for a relatively large format of the signatures, second and third ones of the signature guides being adjustable by the adjusting means so that the arcuate recesses thereof are in phase with the pockets defined by the fan blades. This construction offers the advantage of introducing signatures of large format into the fan pockets of all of the fan blade assemblies arranged on the drive shaft, and of guiding the side or lateral edge of the signatures through fixed lateral signature guides.

In accordance with yet another feature of the invention, the fan delivery includes pins movably fastening the adjustable signature guides to the fan blade assemblies, respectively, the adjusting means including a turning lever connected to the adjustable signature guides selectively into an in-phase and an out-of-phase position. The fastening of the adjustable signature guides to the adjustable fan blade assemblies provides additional construction space for guiding conveyor tapes to locations between the individual fan blade assemblies. The conveyor tapes can then be entrainingly moved together with the adjustable fan belt assemblies when the latter are adjusted. In addition thereto, construction space remains available for adjusting drives. A simple movement of the adjustable signature guides into two adjustment or set positions is realizable by suitably manipulating the turning lever.

In accordance with yet a further feature of the invention, the fan delivery includes a central remote-control system connected to the turning lever for remotely controlling the adjustment of the adjustable signature guides.

In accordance with another feature of the invention, the fan delivery includes an adjusting cylinder actuatable by application of a pressure medium, the adjusting cylinder being controllably connected to the central remote control system, on the one hand, and to the turning lever, on the other hand.

In accordance with an alternate feature of the invention, the fan delivery includes electromagnetic means connecting the central remote-control system to the turning lever for adjusting the adjustable signature guide.

The foregoing features permit the signature guides to be tied into the automatic setting-up of the delivery in accordance with stored information specific to the printing job.

In accordance with a concomitant feature of the invention, the signature guides are formed of acrylic resin.

Other features which are considered as characteristic for the invention are set forth in the appended claims.

Although the invention is illustrated and described herein as embodied in a fan delivery with format-dependent adjustable signature guides, it is nevertheless not intended to be limited to the details shown, since various modifications and structural changes may be made therein without departing from the spirit of the invention and within the scope and range of equivalents of the claims.

Figure 1A:
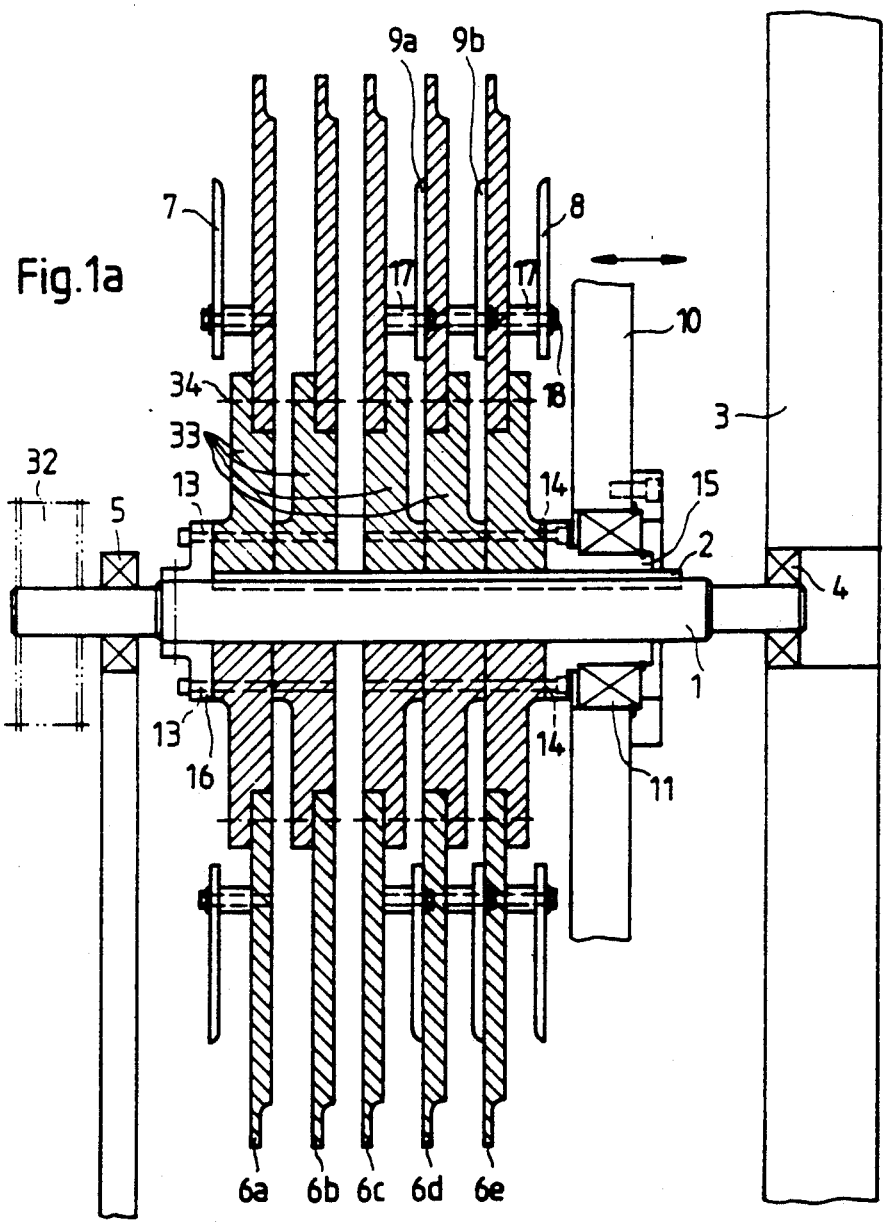
Figure 2:
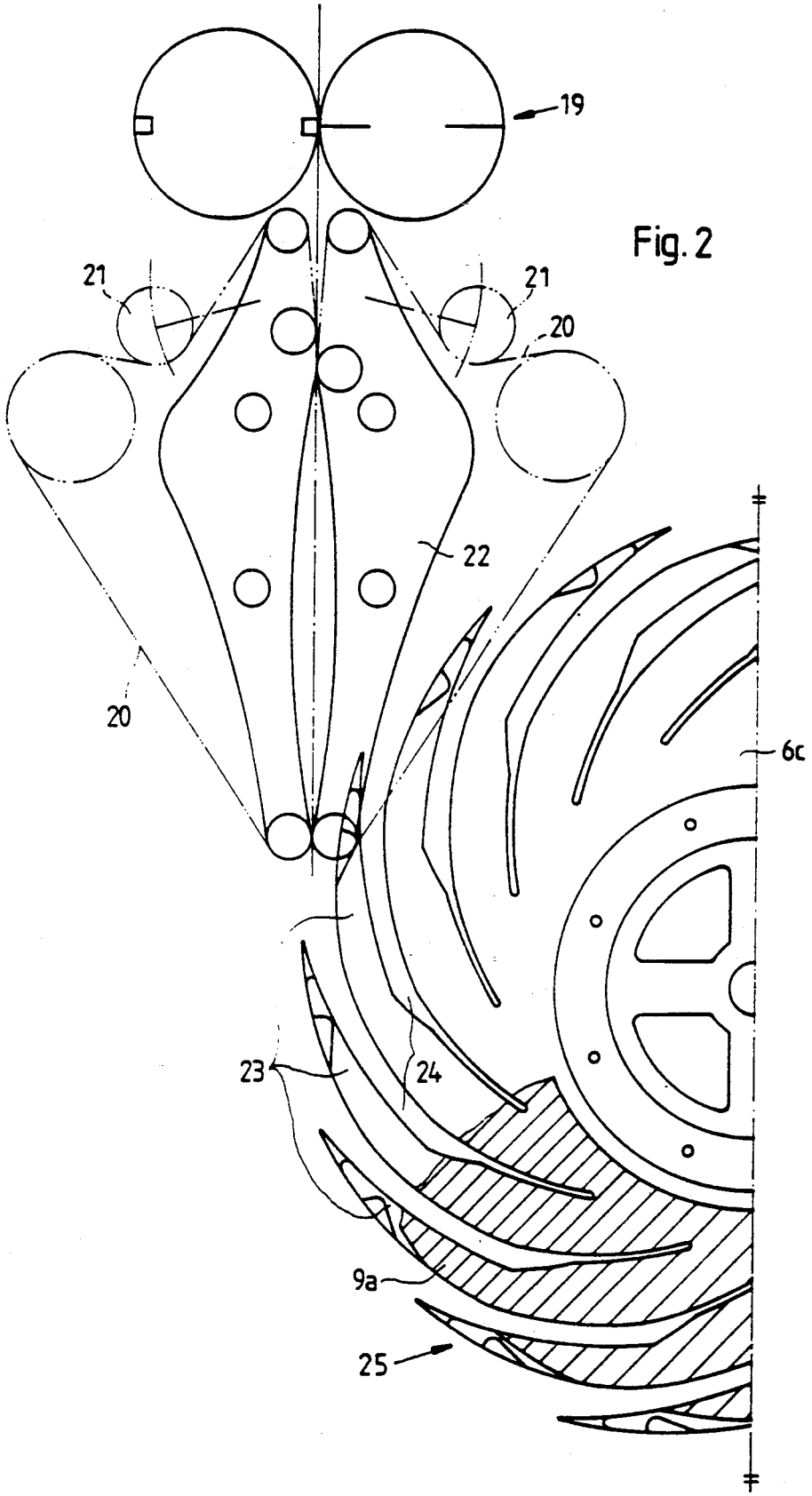
Figures 3A, 3B:
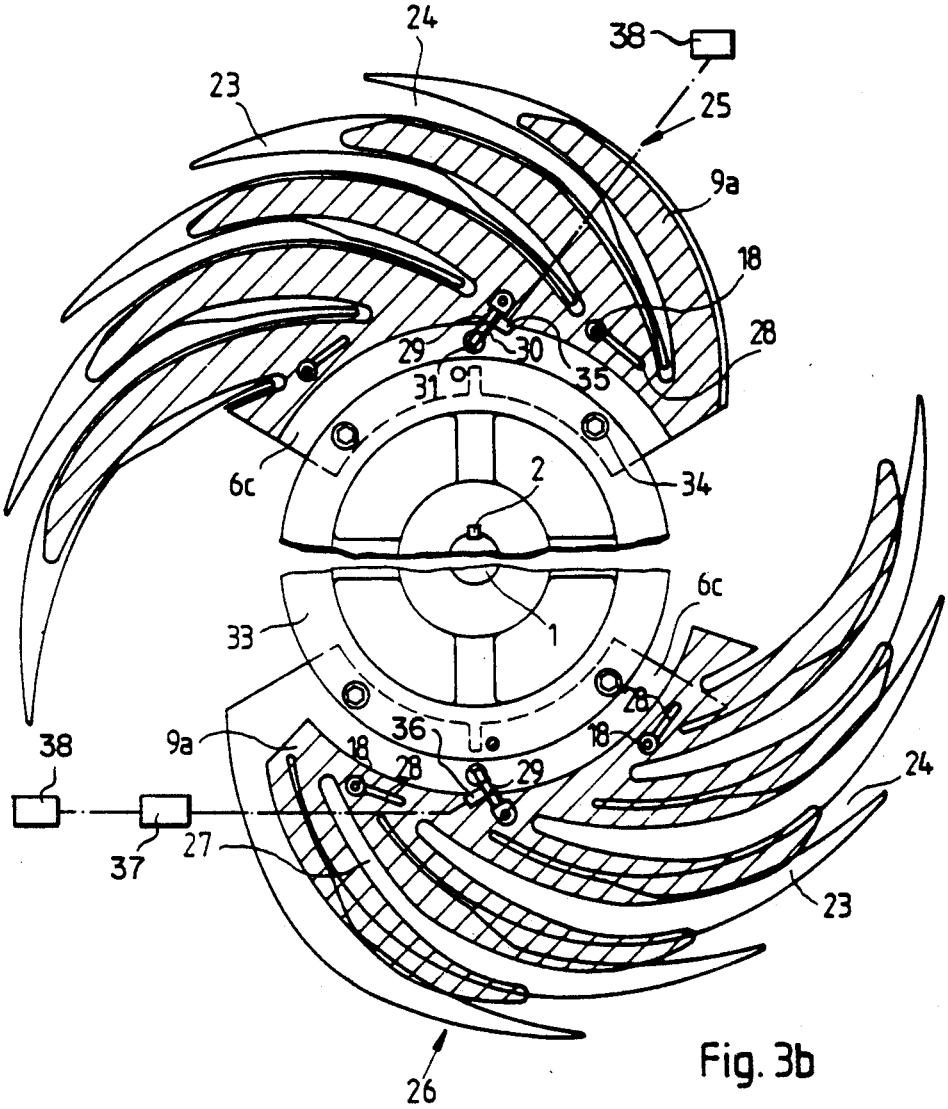

The construction and method of operation of the invention, however, together with additional objects and advantages thereof will be best understood from the following description of specific embodiments when read in connection with the accompanying drawings, in which:

FIG. 1*a* is a diagrammatic longitudinal sectional view of a fan delivery system according to the invention, wherein so-called disappearing rotary side guides for signatures are shown, attached to respective fan blades;

FIG. 1*b* is a fragmentary plan view of signatures of small and large formats, respectively;

FIG. 2 is a diagrammatic side elevational view of a signature feed to fan-blade pockets of the delivery system according to the invention, with the disappearing rotary side guides thereof out of view; and FIGS. 3*a* and 3*b* are fragmentary side elevational views, slightly enlarged over the view of FIG. 2, of another embodiment of the delivery system, in respective "In Phase" and "Out-of-Phase" conditions thereof for receiving signatures fed thereto.

Referring now to the drawings and first particularly to FIG. 1 thereof, there is shown therein a drive shaft 1 supported in bearings 4 and 5 in a folder or folding apparatus. The bearing 4 is carried by a side wall 3. A key 2 is received in a slot formed in the drive shaft 1 and serves to set fan or impeller blade assemblies 6*a* to 6*e* into rotation. The fan blade assemblies 6*a* and 6*b* have supporting discs 33 which are fixed to the drive shaft 1, whereas the fan blade assemblies 6*c*, 6*d* and 6*e* have supporting discs 33 which are slidable in axial direction of the drive shaft 1 along the key 2. The range of displacement of the slidable supporting discs 33 is indicated by a horizontal double-headed arrow.

The supporting disc 33 of the fan blade assembly 6*a* fixed to the drive shaft 1 is provided with a signature guide 7 serving as a lateral guide for the signature and for aligning a side edge of the signature. The supporting disc 33 of the fan blade assembly 6*e* which is slidable on the drive shaft 1 has a signature guide 8 which is fixed to the fan blade assembly 6*e* by a pin or bolt 18 and a sleeve 17. The displaceable or slidable fan blade assemblies 6*c* and 6*d*, on the other hand, are furnished with respective signature guides 9*a* and 9*b* which are adjustable in circumferential direction of the respective fan blade assemblies 6*c* and 6*d* (note also FIG. 3). The three fan blade assemblies 6*c*, 6*d* and 6*e* which are displaceable or slidable on the drive shaft 1 are connected by threaded or screw connections 14 to a hub 15 which is axially displaceable adjustably by an auxiliary frame 10. The latter is supported by a frame bearing 11 on the hub 15. When the auxiliary frame 10 is shifted in either direction of the horizontal arrow, the supporting discs 33 of the fan blade assemblies 6*c*, 6*d* and 6*e* follow the movement thereof. On the opposite side, there is a connection via threaded or screw connections 13 of the respective supporting discs 33 and, accordingly, the fan blade assemblies 6*a* and 6*b* with the hub 16, the latter, in turn, being fixed by a bolt represented diagrammatically by a dash-dot line to the shaft 1.

If signatures having a small format or size 12*a* (note FIG. 1*b*) are received in the fan blade assemblies 6*a*, 6*b* and 6*c*, the signature guide 7 serves as a lateral guide in the fan blade assembly 6*a*. An adjustable signature guide 9*a* at the fan blade assembly 6*c* is remotely controlled into the "out- of-phase" position and thereby forms a lateral guide for the signature. In the "out-of-phase" position, the adjustable signature guide 9*a* is shifted to such an extent with respect to the fan blade assembly 6*c* that fan pockets 24 formed between individual blades 23 of the fan blade assembly 6*c*, for example, are covered by the adjustable signature guide 8*a* (also note FIG. 3). Fine adjustments are possible by means of actuating the auxiliary frame 10, with which also an adjustment or matching of the gap width between the respective blades 23 with an unusual signature or product format may be achieved. The adjustable guide 9*b* at the fan blade assembly 6*d* can be handled or actuated analogously.

In contrast with the foregoing, if signatures with large format or size 12*b* run into the fan blade assemblies 6*a* to 6*e*, the adjustable signature guides 9*a* and 9*b* are set into the "In-phase" position. The arcuate recesses 27 of the adjustable signature guides 9*a* and 9*b* are disposed in the same or like phase position (note FIG. 3) with the fan pockets 24 of the fan blade assemblies 6*c* and 6*d*. The lateral guidance of the signature is assured by the signature guide 8 mounted at the outer fan blade assembly 6*e*. A widening of the lateral displacement range can occur, in turn, by adjusting the auxiliary frame 10 in the respective direction of the horizontal arrow, and a sensitive adjustability is also achievable.

FIG. 2 is side elevational view of the signature feed to the fan pockets. The individual signatures reach a position between conveyor belts or tapes 20 downstream from a cutting-cylinder pair 19. The conveyor belts or tapes 20 are respectively subjected to tension by tensioning rollers 21, and convey the signatures to a fan delivery. Bearing plates 22 serve as a support for further rollers and cylinders in the folder or folding apparatus. Signatures emerging from the lower end of the revolving conveyor belts or tapes 20 reach the fan pockets 24 of the fan blade assembly 6*c* and can enter the respective fan pockets 24 without hindrance.

The adjustable signature guide 9*a* is adjusted so that the fan pockets 24 of the fan blade assembly 6*c* and the arcuate recesses 27 of the adjustable signature guide 9*a* lie mutually "in phase", as represented generally by the reference numeral 25.

In FIG. 3*a*, the setting of a signature guide in "in-phase" position and, in FIG. 3*b*, in "out-of-phase" position are shown. The adjustable fan blade assembly 6*c* is formed with fan pockets 24 between the individual fan blades 23 thereof. An adjustable signature guide 9*a* is movably mounted on the fan blade assembly 6*c* by means of bolts 18 which can be shifted in slots 28 in circumferential direction. In the "in-phase" position of FIG. 3*a*, it is readily apparent that the fan pockets 24 in the fan blade assembly 6*c* are aligned with the arcuate recesses 27 formed in the adjustable signature guide 9*a*. This corresponds to the adjusted position which is set when large-format or large-size signatures or folded products having a width extending over more then three fan blade assemblies are processed in the fan delivery.

The path of adjustment of the "in-phase" position to the "out-of-phase" position is prescribed by the length of the slots 28 in the circumferential direction, and can be adjusted individually. A switchover from the set "in-phase" position 25 to the set "out-of-phase" position 26 is effected by swinging a pivot or turning lever 29 by means of an activating lever 31 and, reinforced by a force of a spring 30 illustrated diagrammatically by broken lines, the adjustable signature guide 9*a* is set into the "out-of-phase" position 26. In FIG. 3*b*, the adjustable signature guide 9*a* is shown as having been turned with respect to the fan pockets 24 of the fan blade assembly 6*c* so that the fan pockets 24 are closed by the signature guide 9*a*. This is the case, for example, when signatures having a small format 12*a* are to be run into the fan delivery and are to be correctly delivered. If the width of such very small signatures extends over the three fan blade assemblies 6*a*, 6*b* and 6*c*, the signature guide 9*a* is brought by remote control 38 into the "out-of-phase" position 26. Then, a lateral guidance also of very small signatures is assured, and the fine adjustment due to the lateral displaceability ensures a careful treatment of the signature or folded product and high delivery quality.

In FIGS. 3*a* and 3*b*, the drive shaft 1 and the key 2 mounted thereon are furthermore apparent. The support disc 33 is shown therein connected via several threaded members or screws 34 to the fan blade assembly 6*c*. The drive shaft 1 is driven by a drive gear 32. The signature guides 9*a*, 9*b* may be formed of thin stiff material such as plastic material or thermoplastic sheets of acrylic resin such as methyl acrylate, known by the trade name "plexiglas", for example.

The adjustable signature guides 9*a* and 9*b* may be adjusted electromagnetically as at 35 or by adjusting cylinders 36 subjected to a pressure medium as at 37, which may be installed in the vicinity of the connection between the supporting disc 33 and the fan blade assemblies 6*c* and 6*d*. This permits a tie-in thereof with the remote control system 38. The capability of installing the adjusting cylinder which requires little construction space further permits conveyor belts or tapes to the fan delivery or delivery belts or tapes whereon the signatures can be laid out to be guided into the intermediate spaces between the individual fan blade assemblies 6*a* to 6*e*. The conveyor belts or tapes or delivery belts or tapes can then be entrainingly displaced axially in either direction of the horizontal arrow shown in FIG. 1. This can be effected both within the limits of a job-specific setting-up period as well as during operation of the printing machine. Service personnel including the pressman can thus be relieved of adjusting work and can give their attention to monitoring activities

I claim:

1. Fan delivery for a rotary printing press, comprising a drive shaft, a fan arrangement including a plurality of fan blade assemblies disposed adjacent and spaced from one another on said drive shaft, signature guides formed with arcuate recesses, respectively mounted between mutually adjacent fan blade assemblies of said fan arrangement, and means for adjusting at least some of said signature guides with respect to said fan blade assemblies for varying formats of signatures in accordance with the size of the signatures.

2. Fan delivery according to claim 1, wherein said adjusting means are remotely controllable.

3. Fan delivery according to claim 1, wherein said fan blade assemblies are displaceable on said drive shaft in axial direction thereof.

4. Fan delivery according to claim 1, wherein said fan blade assemblies, respectively, are formed of outwardly extending blades defining pockets therebetween, a first one of said signature guides serving as a lateral stop for a relatively small format of the signatures, and a first one of said adjustable signature guides having said arcuate recesses thereof disposed in opposite phase to said pockets between said fan blades.

5. Fan delivery according to the claim 1, wherein said fan blade assemblies, respectively, are formed of outwardly extending blades defining pockets therebetween, a first one of said signature guides being fixed and serving as a lateral stop for a relatively large format of the signatures, second and third ones of said signature guides being adjustable by said adjusting means so that said arcuate recesses thereof are in phase with said pockets defined by s id fan blades.

6. Fan delivery according to claim 1, including pins movably fastening said adjustable signature guides to said fan blade assemblies, respectively, said adjusting means including a turning lever connected to said adjustable signature guides selectively into an in-phase and an out-of-phase position.

7. Fan delivery according to claim 6, including a central remote-control system connected to said turning lever for remotely controlling the adjustment of said adjustable signature guides.

8. Fan delivery according to claim 7, including an adjusting cylinder actuatable by application of a pressure medium, said adjusting cylinder being controllably connected to said central remote control system, on the one hand, and to said turning lever, on the other hand.

9. Fan delivery according to claim 7, including electromagnetic means connecting said central remote-control system to said turning lever for adjusting said adjustable signature guide.

10. Fan delivery according to claim 1, wherein said signature guides are formed of acrylic resin.

* * * * *